US008083533B2

(12) United States Patent
De Chazal

(10) Patent No.: US 8,083,533 B2
(45) Date of Patent: Dec. 27, 2011

(54) CONNECTOR ASSEMBLY FOR AN INTERLOCK CIRCUIT

(75) Inventor: Aaron James De Chazal, Rochester, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 72 days.

(21) Appl. No.: 12/703,834

(22) Filed: Feb. 11, 2010

(65) Prior Publication Data

US 2011/0195587 A1 Aug. 11, 2011

(51) Int. Cl.
*H01R 33/96* (2006.01)

(52) U.S. Cl. ..... 439/188; 200/51.09

(58) Field of Classification Search ..... 439/188, 439/924.1, 924.2; 200/51.09
See application file for complete search history.

(56) References Cited

U.S. PATENT DOCUMENTS

| | | | | |
|---|---|---|---|---|
| 2,542,404 | A * | 2/1951 | Ensign | 307/112 |
| 3,270,267 | A * | 8/1966 | Nolte, Jr. | 320/138 |
| 4,012,681 | A * | 3/1977 | Finger et al. | 320/109 |
| 4,044,208 | A * | 8/1977 | McDonald et al. | 200/51.09 |
| 6,123,569 | A * | 9/2000 | Fukushima et al. | 439/456 |
| 6,648,669 | B1 * | 11/2003 | Kim et al. | 439/357 |
| 7,217,150 | B2 * | 5/2007 | Lekic et al. | 439/352 |
| 7,508,097 | B2 * | 3/2009 | Furuta et al. | 307/328 |
| 7,641,499 | B1 | 1/2010 | George et al. | |
| 7,789,690 | B1 * | 9/2010 | Rhein | 439/310 |
| 7,811,115 | B1 * | 10/2010 | Tyler | 439/352 |
| 2011/0195587 | A1 * | 8/2011 | De Chazal | 439/188 |

FOREIGN PATENT DOCUMENTS

| | | |
|---|---|---|
| DE | 10 2006 044655 | 2/2008 |
| DE | 10 2007 010515 | 9/2008 |
| DE | 10 2007 026261 | 12/2008 |
| WO | WO 2008/109109 | 9/2008 |

OTHER PUBLICATIONS

International Search Report, International Application No. PCT/US2011/000256, International Filing Date, Nov. 2, 2011.

* cited by examiner

*Primary Examiner* — Neil Abrams

(57) ABSTRACT

A connector assembly includes a housing, a current carrying conductor, and an interlock conductor. The housing has a cavity that receives conductive members and a shunt of a first connector. The cavity is bifurcated into a conductor channel and an interlock channel that receives a conductive member of a second connector. The current carrying conductor is in the housing and extends through the cavity and the conductor channel. The interlock conductor is in the housing and extends through the cavity and the interlock channel. The interlock conductor closes an interlock circuit when the interlock conductor mates the shunt of the first connector with the conductive member of the second connector. The current carrying conductors mate to the conductive members of the first connector to begin transferring electric current through the current carrying conductor when the interlock circuit is closed.

22 Claims, 6 Drawing Sheets

CONNECTOR ASSEMBLY FOR AN INTERLOCK CIRCUIT

BACKGROUND OF THE INVENTION

The subject matter described herein relates generally to connectors, and more particularly, to connectors used with an interlock circuit.

Connectors may be used in high voltage applications, such as in hybrid or all-electric automobiles, to transfer relatively high voltage current from a power source to one or more electric loads. For example, connectors may electrically couple a battery with heating elements, control systems, transmissions, and the like, in an automobile. The high voltage current that is transmitted using these connectors may require safeguards to ensure that operators of the automobile and other electronic components in the automobile are not harmed by the current.

Some known high voltage (HV) devices or connectors have interlock circuits that control when current is transmitted from a power source to electric loads. The interlock circuits may be used to ensure that a power supply circuit that includes the power source and the loads is closed prior to transferring the current along or through the circuit. For example, some known devices include a header connector that is mounted to the outside of the device. The header connector may be directly wired to an interlock circuit within the device. The header connector also may include contacts that transfer current through a power supply circuit. A plug connector mates with the header connector to electrically couple the contacts of the interlock circuit. For example, the plug connector may include a conductive shunt that bridges the contacts of the interlock circuit to close the interlock circuit. The plug connector also includes contacts that are joined to electric loads. The contacts of the electric loads mate with the contacts of the power supply circuit in the header assembly to close the power supply circuit. In doing so, the header assembly transfers or receives current to the contacts of the plug connector once the shunt of the plug connector closes the interlock circuit.

But, header connectors are fixed in location. For example, header connectors may only be mounted to the exterior of a device. A need exists for a connector that is not mounted as a header connector and that closes an interlock circuit. Another problem is having numerous connectors to mate with each different HV connector having a high voltage interlock (HVIL) circuit.

BRIEF DESCRIPTION OF THE INVENTION

In one embodiment, a connector assembly is provided. The connector assembly includes a housing, a current carrying conductor, and an interlock conductor. The housing has a cavity that receives conductive members and a shunt of a first connector. The cavity is bifurcated into a conductor channel and an interlock channel that receives a conductive member of a second connector. The current carrying conductor is in the housing and extends through the cavity and the conductor channel. The interlock conductor is in the housing and extends through the cavity and the interlock channel. The interlock conductor closes an interlock circuit when the interlock conductor mates the shunt of the first connector with the conductive member of the second connector. The current carrying conductors mate to the conductive members of the first connector to begin transferring electric current through the current carrying conductor when the interlock circuit is closed.

In another embodiment, another in-line connector assembly is provided. The connector assembly includes a housing, a current carrying conductor, and an interlock conductor. The housing extends between a front end and a back end. The front end defines a connector interface and the back end defines an interlock interface and a conductor interface. The connector interface mates with a first connector and the interlock interface mates with a second connector. The current carrying conductor is disposed in the housing and extends from the connector interface to the conductor interface. The interlock conductor is disposed in the housing and extends from the connector interface to the interlock interface. The interlock conductor is configured to close an interlock circuit that begins transferring the electric current through the current carrying conductor when the interlock circuit is closed.

DETAILED DESCRIPTION OF THE INVENTION

Figure 1:
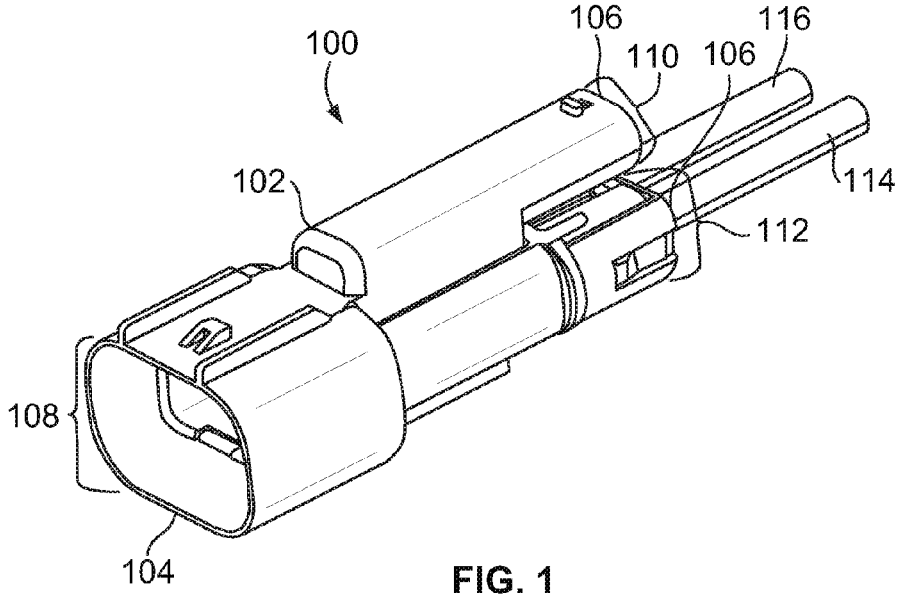
FIG. 1 is a perspective view of an in-line connector assembly in accordance with one embodiment.
Figure 2:
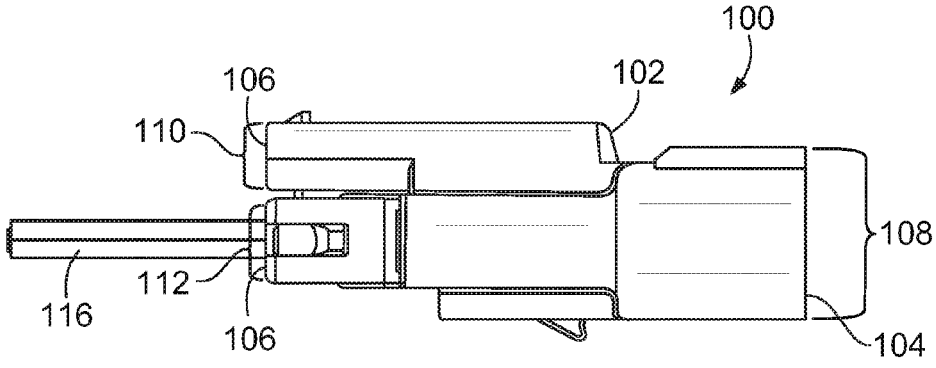
FIG. 2 is a side view of the connector assembly shown in FIG. 1.

FIG. 1 is a perspective view of a connector assembly 100 in accordance with one embodiment of the present disclosure. FIG. 2 is a side view of the connector assembly 100 shown in FIG. 1. The connector assembly 100 includes a housing 102 that extends between opposite front and back ends 104, 106. In the illustrated embodiment, the housing 102 is a one-piece housing. For example, the housing 102 may be molded as a unitary body formed from a dielectric material, such as one or more polymers. As shown in FIG. 1, the front end 104 defines a mating connector interface 108 that is shaped to mate with a mating connector 300 (shown in FIG. 3). The front end 104 is shaped to define a shroud or port that couples with the mating connector 300. For example, the mating connector interface 108 may mate with a mating connector such as the plug connector assembly 2 shown and described in U.S. Pat. No. 7,811,115, which is entitled "Connector Assembly With Two Stage Latch" (the "'115 Patent"). The housing 102 encircles the connector interface 108 to delimit the outer boundaries or periphery of the mating connector interface 108. In the illustrated embodiment, the mating connector interface 108 is capable of mating with only a single connector. In alternative embodiments, however, the connector interface 108 may mate with multiple connectors and/or the front end 104 may include several shrouds or ports that define separate connector interfaces 108.

The back end 106 of the housing 102 defines two interfaces, namely an interlock mating interface 110 and a conductor interface 112. Similar to the connector interface 108, the housing 102 forms shrouds or ports that encircle each of the interlock and conductor interfaces 110, 112 to delimit the outer boundaries or peripheries of the interlock and conductor interfaces 110, 112. As shown in the illustrated embodiment, the interlock interface 110 and the conductor interface 112 are separate from each other. For example, the interlock interface 110 and the conductor interface 112 are spaced apart from each other such that the outer boundary of one interface 110, 112 does not extend into or overlap with the other interface 110, 112.

The interlock interface 110 is shaped to mate with another mating HVIL or low voltage (LV) connector while the conductor interface 112 has two cables 114, 116 extending from the housing 102. In the illustrated embodiment, the interlock interface 110 is capable of mating with only a single HVIL or LV connector. In alternative embodiments, however, the interlock interface 110 may mate with multiple connectors and/or the back end 106 may include several shrouds or ports that define separate interlock interfaces 110.

As described below, the connector assembly 100 shown in FIG. 1 is an in-line connector with the housing 102 providing a single mating interface (for example, the connector interface 108) at the front end 104 of the housing 102 and two interfaces (for example, the interlock interface 110 and the conductor interface 112) at the back end 106. Alternatively, one or more ends 104, 106 of the housing 102 may have a different number of interfaces. Interlock conductors 308, 310 (shown in FIG. 3) and current carrying conductors 332, 334 (shown in FIG. 3) are disposed in the housing 102 such that the interlock conductors 308, 310 and the current carrying conductors 332, 334 extend from the connector interface 108 to mate with contacts or conductors in a first or mating connector 300 (shown in FIG. 3) The interlock conductors 308, 310 extend to the interlock interface 110 to mate with a second or HVIL connector 302 (shown in FIG. 3) while the current carrying conductors 332, 334 may extend to and be joined with the cables 114, 116 that protrude through the conductor interface 112. Alternatively, the first and/or second connector 300 may be a header assembly that is mounted to an exterior surface of a device.

Figure 3:
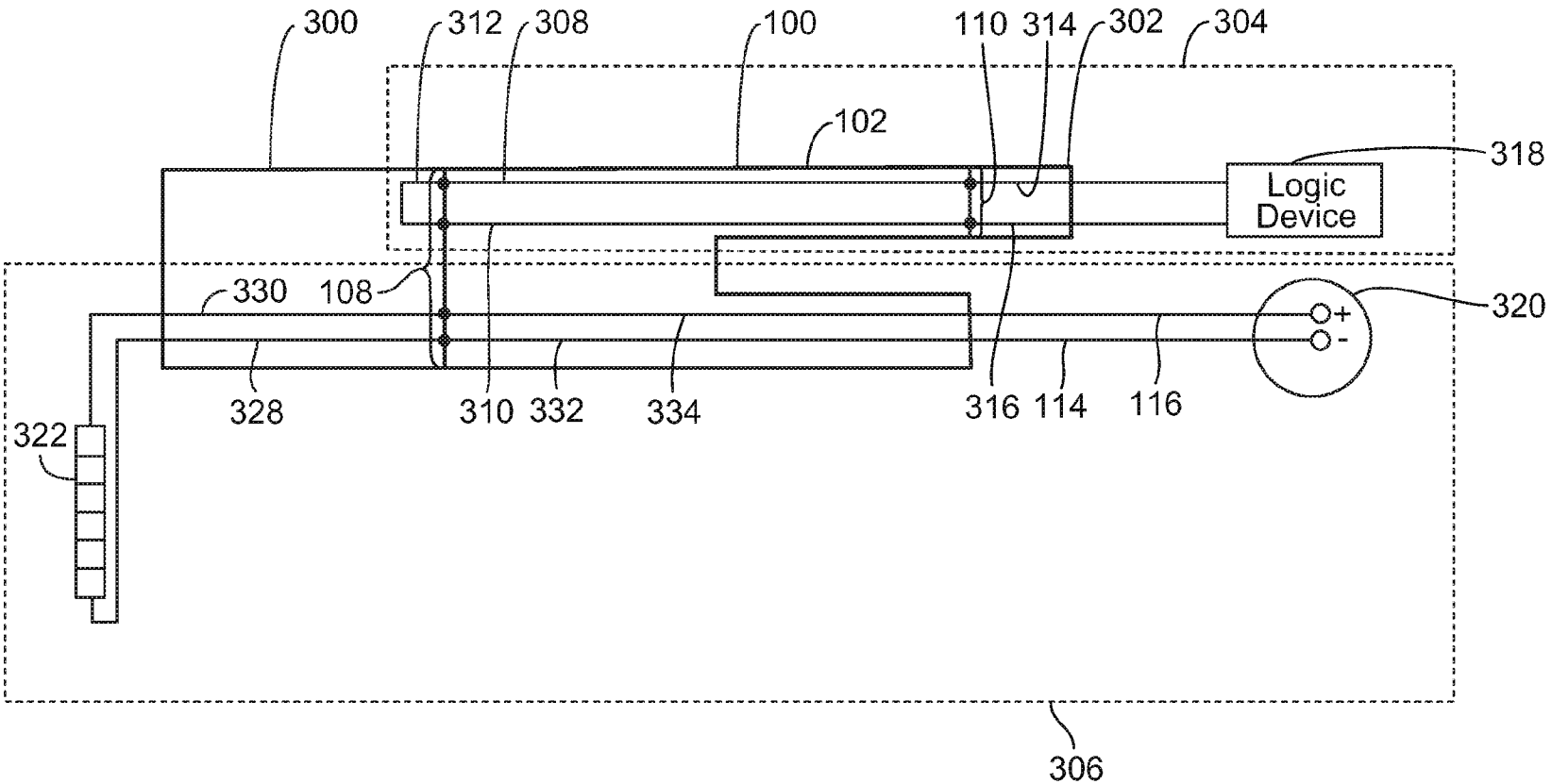
FIG. 3 is a schematic circuit diagram of the connector assembly shown in FIG. 1 mated with a first connector and a second connector in accordance with one embodiment.

FIG. 3 is a schematic circuit diagram of the connector assembly 100 mated with the first connector 300 and the second connector 302 in accordance with one embodiment of the present disclosure. The connector assembly 100 mates with the first and second connectors 300, 302 to close an interlock circuit 304 and a power supply circuit 306. The interlock circuit 304 controls transfer of electric current through the power supply circuit 306. For example, the interlock circuit 304 may prevent electric current from being transmitted through the power supply circuit 306 until the interlock circuit 304 is closed.

The interlock circuit 304 may be used as a safety feature to prevent electric current from being transferred through the power supply circuit 306 until the power supply circuit 306 is closed. For example, as shown and described in the '115 Patent, the first connector 300 may have a feature that ensures that the power supply circuit 306 is opened only after the interlock circuit 304 is opened by the unmating of the first connector 300 with the connector assembly 100. Such a feature may prevent high voltage electric current from being applied to terminals or conductors in the open power supply circuit 306. For example, such a feature of the first connector 300 may ensure that the interlock circuit 304 is opened for a predetermined time before the power supply circuit 306 is opened to allow sufficient time for components along the power supply circuit 306 to dissipate any high voltage or built up charge after the electric current is no longer transmitted through the power supply circuit 306 and before the power supply circuit 306 is opened.

The interlock circuit 304 includes the interlock conductors 308, 310 in the connector assembly 100, a shunt 312 in the mating connector 300, conductive members 314, 316 in the HVIL connector 302, and a logic device 318. The logic device 318 may be part of the connector 302 or separate therefrom. The shunt 312 may be a conductive body that mates with the interlock conductors 308, 310 at the connector interface 108 to bridge a gap between the interlock conductors 308, 310. The conductive members 314, 316 of the second connector 302 may be conductive bodies such as contacts or terminals that mate with the interlock conductors 308, 310 of the connector assembly 100 at the interlock interface 110. The conductive members 314, 316 are electrically coupled with the logic device 318. As shown in FIG. 3, when the first and second connectors 300, 302 mate with the connector assembly 100 at the connector interface 108 and the interlock interface 110, the interlock circuit 304 is closed.

The logic device 318 is a device that communicates with a power source 320 to direct the power source 320 when to begin or stop transmitting electric current through the power supply circuit 306. The logic device 318 may be embodied in one or more computer logic components, such as a microcontroller, processor, microprocessor, computer, and/or software operating on a processor, microprocessor, or computer. The power source 320 is a source of electric current, such as a high voltage battery. The logic device 318 determines when the interlock circuit 304 is open or closed. If the logic device 318 determines that the interlock circuit 304 is closed, the logic device 318 directs the power source 320 to begin supplying electric current through the power supply circuit 306. If the logic device 318 determines that the interlock circuit 304 is open, the logic device 318 directs the power source 320 to stop supplying current through the power supply circuit 306

The power supply circuit 306 may include one or more electric loads 322 that are joined with the power source 320 and the first connector 300. The electric load 322 represents one or more devices that draw electric current from the power source 320. The electric load 322 may be coupled with conductive members 328, 330 in the first connector 300. The conductive members 328, 330 mate with current carrying conductors 332, 334 in the connector assembly 100 in the connector interface 108 of the connector assembly 100. The current carrying conductors 332, 334 are joined with or extend through the cables 114, 116. The cables 114, 116 are electrically coupled with the power source 320. The current carrying conductors 332, 334 may be conductors that are adapted to transfer relatively high voltage current through the connector assembly 100.

The power supply circuit 306 is closed when the first connector 300 mates with the connector assembly 100 at the connector interface 108. The interlock circuit 304 is closed when the first connector 300 mates with the connector interface 108 and the second connector 302 mates with the interlock interface 110. As described above, once the interlock circuit 306 is closed, the power source 320 begins transferring electric current through the power supply circuit 306.

As described herein, in accordance with one embodiment, the connector assembly 100 is configured to interface between the mating connector 300 that has an integral HVIL circuit, or the shunt 312, and an HVIL connector such as the second connector 302 that can be of variety of forms. For example, the second connector 302 may be a connector that does not include any high voltage current carrying conductors.

Figure 4:
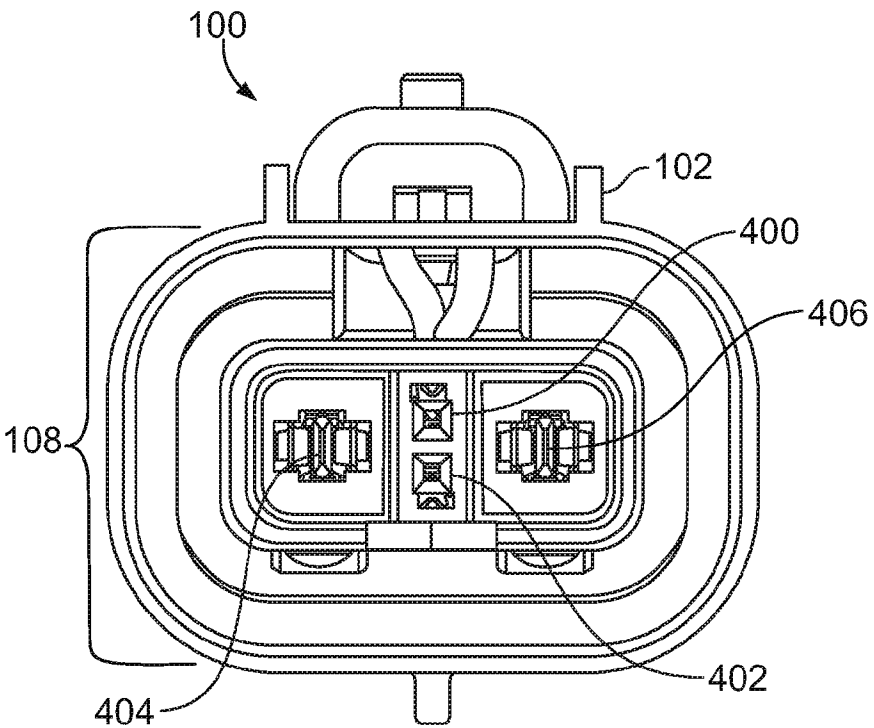
FIG. 4 is a view of a connector interface of the connector assembly shown in FIG. 1 in accordance with one embodiment.

FIG. 4 is a view of the connector interface 108 of the connector assembly 100 in accordance with one embodiment of the present disclosure. The interlock conductors 308, 310 (shown in FIG. 3) extend to forward ends 400, 402 disposed in the connector interface 108 of the housing 102. The forward ends 400, 402 may be conductive terminals or contacts to which the interlock conductors 308, 310 are terminated. The current carrying conductors 332, 334 (shown in FIG. 3) extend to first ends 404, 406 in the connector interface 108. The first ends 404, 406 may be conductive terminals or contacts to which the current carrying conductors 332, 334 are joined. As shown in FIG. 4, both the forward ends 400, 402 of the interlock conductors 308, 310 and the first ends 404, 406 of the current carrying conductors 332, 334 are disposed within the single connector interface 108 and encircled by the housing 102 within the connector interface 108. A single connector, such as the first connector 300 (shown in FIG. 3), may engage the housing 102 at the connector interface 108 to mate the conductive members 328, 330 (shown in FIG. 3) with the current carrying conductors 332, 334 and to mate the shunt 312 with the interlock conductors 308, 310.

Figure 5:
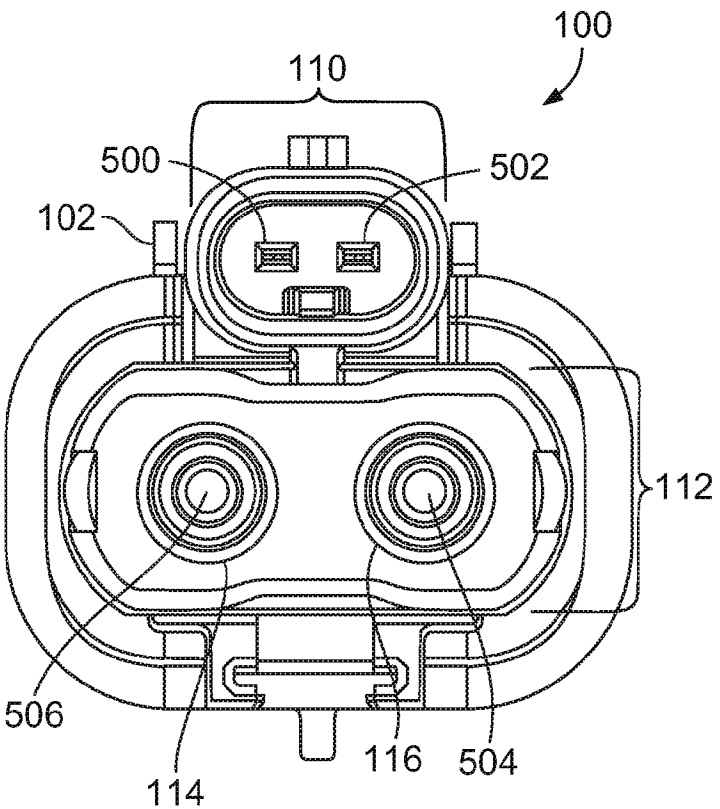
FIG. 5 is a view of interlock and conductor interfaces of the connector assembly shown in FIG. 1 in accordance with one embodiment.

FIG. 5 is a view of the interlock and conductor interfaces 110, 112 of the connector assembly 100 in accordance with one embodiment of the present disclosure. The interlock conductors 308, 310 (shown in FIG. 3) extend to rear ends 500, 502 disposed in the interlock interface 110 of the housing 102. The rear ends 500, 502 may be conductive terminals or contacts to which the interlock conductors 308, 310 are terminated. The current carrying conductors 332, 334 (shown in FIG. 3) extend to second ends 504, 506 in the connector interface 108. The second ends 504, 506 may be conductive terminals or contacts to which the current carrying conductors 332, 334 are joined. In contrast to the single mating connector interface 108 as shown in FIG. 4, the rear ends 500, 502 of the interlock conductors 308, 310 are disposed in a different interface than the second ends 504, 506 of the current carrying conductors 332, 334. The rear ends 500, 502 of the interlock conductors 308, 310 are located within the interlock interface 110 and encircled by the housing 102 within the interlock interface 110 while the second ends 504, 506 of the current carrying conductors 332, 334 extend through the conductor interface 112 and into the cables 114, 116. A single connector, such as the second connector 302 (shown in FIG. 3), may engage the housing 102 at the interlock interface 110 to mate the conductive members 328, 330 (shown in FIG. 3) with the interlock conductors 308, 310 while not mating with or engaging the current carrying conductors 332, 334. For example, a user of the connector assembly 100 may use a separate second connector 302 to the interlock circuit 304 to close the interlock circuit 304 with the cables 114, 116 bypassing the second connector 302 and extending to, by way of example only, the power source 320 (shown in FIG. 3) and/or one or more electric loads 322 (shown in FIG. 3).

Figure 6:
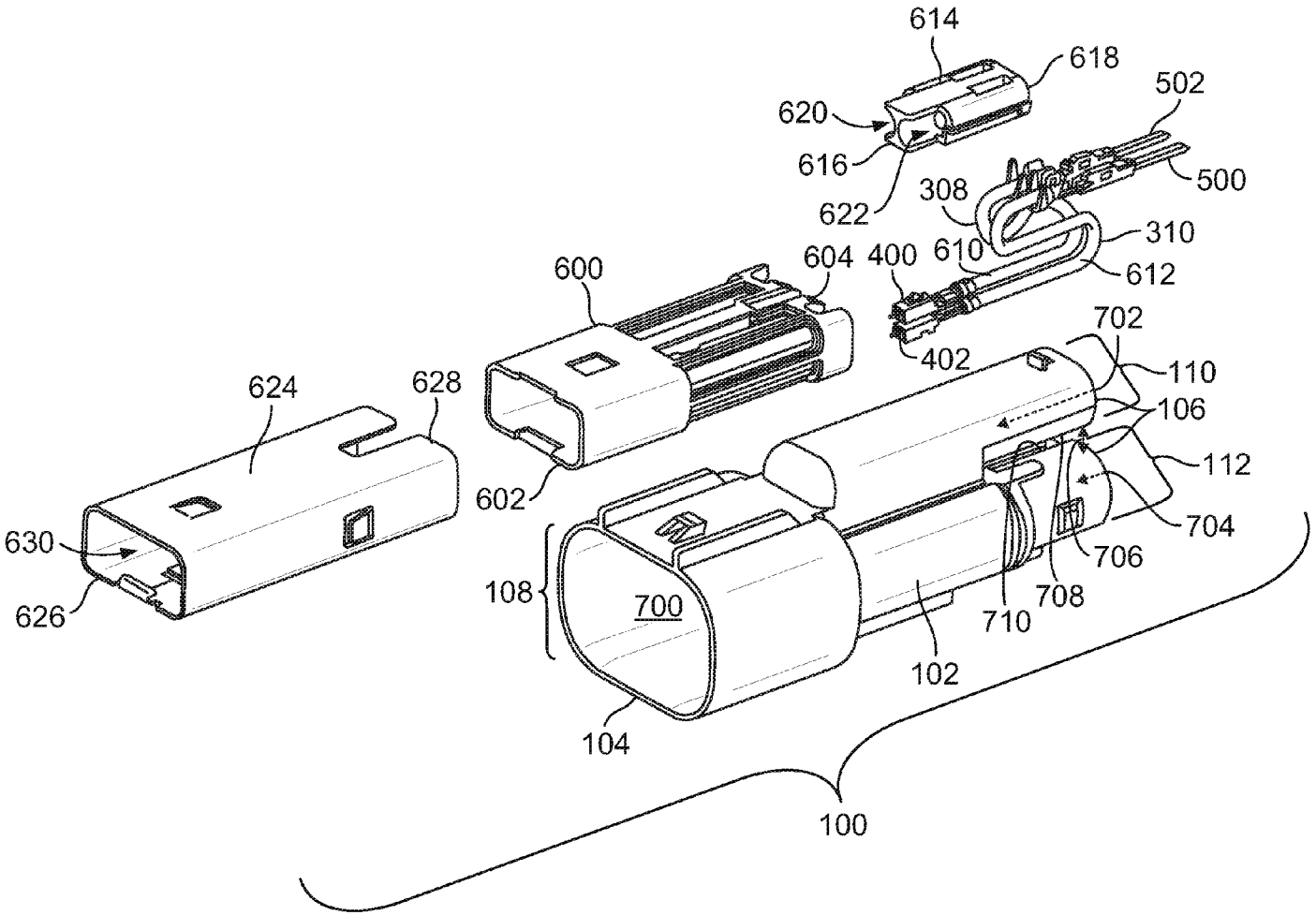
FIG. 6 is an exploded view of the connector assembly shown in FIG. 1 in accordance with one embodiment.

FIG. 6 is an exploded view of the connector assembly 100 in accordance with one embodiment of the present disclosure. The connector assembly 100 includes a conductor casing 600 that is elongated between opposite front and back sides 602, 604. The casing 600 receives and holds the current carrying conductors 332, 334 (shown in FIG. 3) and the interlock conductors 308, 310. The back side 604 of the casing 600 may be at least partially open in order to receive the interlock conductors 308, 310.

The interlock conductors 308, 310 extend from the forward ends 400, 402 to rear ends 500, 502. The interlock conductors 308, 310 may be separately enclosed within dielectric sheaths or jackets 610, 612 between the forward ends 400, 402 and rear ends 500, 502. The rear ends 500, 502 may be conductive terminals, such as rigid or semi-rigid conductive bodies. The forward ends 400, 402 are electrically coupled with the rear ends 500, 502 by one or more conductors, such as wires, extending through the sheaths 610, 612. The interlock conductors 308, 310 are loaded into the casing 600 such that the forward ends 400, 402 are located closer to the front side 602 than the back side 604 of the casing 600 and that the rear ends 500, 502 protrude from the back side 604.

The interlock conductors 308, 310 may be flexible but have sufficient rigidity to maintain a desired shape. For example, the sheaths 610, 612 may be bent or twisted into a variety of configurations, such as the S-shape shown in FIG. 6, while maintaining the configuration until bent or twisted into another shape. The interlock conductors 308, 310 may be sufficiently rigid to hold a configuration or position and not change the configuration or position due to, for example, the force of gravity, when the interlock conductors 308, 310 are unsupported.

An electromagnetic shield 624 extends between opposite ends 626, 628. The shield 624 includes or is formed from a conductive material, such as a metal or metal alloy. The shield 624 defines an interior chamber 630 that extends through the shield 624 from one end 626 to the other end 628. The casing 600 is loaded into the interior chamber 630. The shield 624 may engage or mate with a conductive shield or other conductive member (not shown) of the first connector 300 (shown in FIG. 3) in order to electrically join the shield 624 with a ground reference or to another conductive body. The shield 624 restricts emission of electromagnetic interference generated by or emanating from the current carrying conductors 332, 334 (shown in FIG. 3).

A terminal retainer 614 is an elongated case that extends between opposite sides 616, 618. The retainer 614 includes side-by-side channels 620, 622 in the illustrated embodiment to receive the rear ends 500, 502 of the interlock conductors 308, 310. The rear ends 500, 502 are received in the retainer 614 so that the retainer 614 can hold the rear ends 500, 502 in a predetermined spatial arrangement. For example, the retainer 614 may hold the rear ends 500, 502 in a spaced apart relationship within the housing 102 that corresponds to the conductive members 314, 316 (shown in FIG. 3) of the second connector 302 (shown in FIG. 3).

The housing 102 includes an interior cavity 700 that inwardly extends from the connector interface 108 at the front end 104. The cavity 700 receives the first connector 300 (shown in FIG. 3) and/or shunt 312 and conductive members 328, 330 (shown in FIG. 3) of the first connector 300 when the first connector 300 mates with the housing 102 at the connector interface 108. The cavity 700 extends from the connector interface 108 at the front end 104 toward the back end 106 of the housing 102. The cavity 700 is split, or bifurcated, within the housing 102 into an interlock channel 702 and a conductor channel 704. The cavity 700 merges into the interlock channel 702 and the conductor channel 704 approximately halfway between the front and back ends 104, 106.

The interlock channel 702 inwardly extends into the housing 102 from the interlock interface 110 at the back end 106 of the housing 102 toward the front end 104. The conductor channel 704 inwardly extends into the housing 102 from the conductor interface 112 at the back end 106 toward the front end 104. The interlock conductors 308, 310 (shown in FIG. 3) are placed within the housing 102 such that the interlock conductors 308, 310 extend from the forward ends 400, 402 (shown in FIG. 4) located near the connector interface 108, through the cavity 700 and the interlock channel 702 to the rear ends 500, 502 (shown in FIG. 5) located in positions near the interlock interface 110. The current carrying conductors 332, 334 (shown in FIG. 3) are located in the housing 102 such that the current carrying conductors 332, 334 extend from the first ends 404, 406 (shown in FIG. 4) located near the connector interface 108, through the cavity 700 and the conductor channel 704 to positions near the conductor interface 112. In one embodiment, the current carrying conductors 332, 334 extend into the cables 114, 116 (shown in FIG. 1) that protrude from the conductor channel 704 and out of the back end 106 of the housing 102 through the conductor interface 112.

The interlock interface 110 and the conductor interface 112 are spaced apart from one another by a gap 706 in the back end 106 of the housing 102. The housing 102 includes an internal upper wall 708 and an internal lower wall 710 that extend from the back end 106 toward the front end 104. The gap 706 is the space between the internal walls 708, 710 and located outside of the housing 102.

In the illustrated embodiment, the internal walls 708, 710 provide separation and demarcation of boundaries between the interlock channel 702 and the conductor channel 704. For example, the interlock channel 702 and conductor channels 704 are located within the housing 102 on opposite sides of the gap 706 and the internal walls 708, 710. Alternatively, the housing 102 may include an internal wall that separates the interlock and conductor channels 702, 704 without having the gap 706. For example, a wall or surface may be provided in the housing 102 that separates the interlock and conductor channels 702, 704 from each other.

Figure 7:
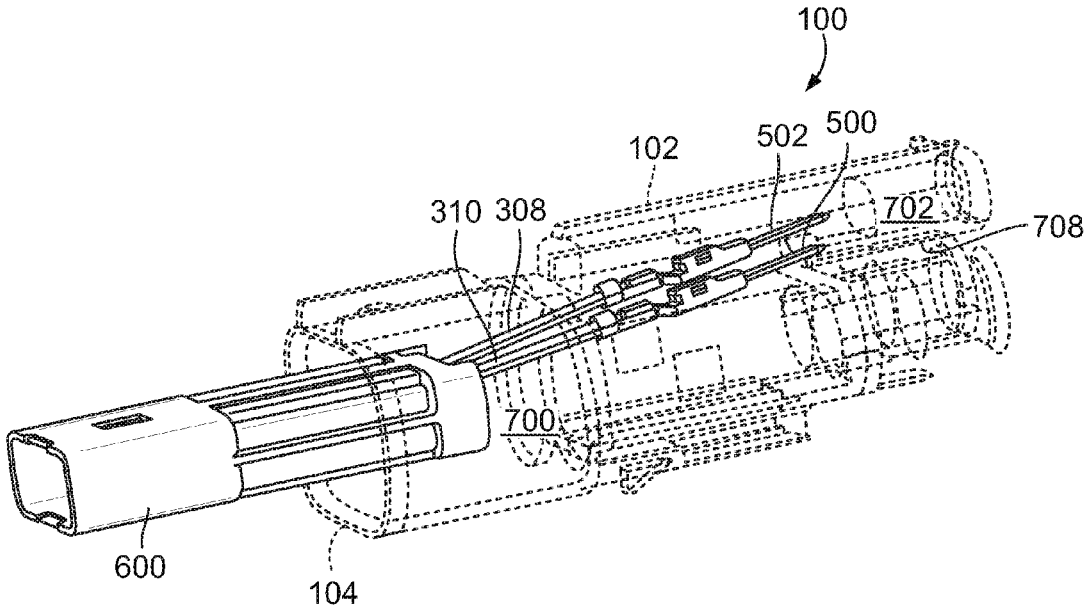
FIG. 7 is a perspective view of the connector assembly shown in FIG. 1 in a first stage of assembly with the housing shown in FIG. 1 shown in phantom in accordance with one embodiment.

FIG. 7 is perspective view of the connector assembly 100 in a first stage of assembly with the housing 102 shown in phantom in accordance with one embodiment of the present disclosure. The view shown in FIG. 7 does not include the shield 624 (shown in FIG. 6) so that the casing 600 may be more clearly seen. Once the interlock conductors 308, 310 and current carrying conductors 332, 334 (shown in FIG. 3) are loaded into the casing 600 and the casing 600 is inserted into the shield 624, the casing 600 and shield 624 are loaded into the cavity 700 of the housing 102 through the front end 104 of the housing 102.

The casing 600 is inserted into the housing 102 such that the interlock conductors 308, 310 are directed along the cavity 700 and into the interlock channel 702 as the casing 600 is moved into the housing 102. For example, the casing 600 may be loaded into the housing 102 such that the rear ends 500, 502 are directed above the internal upper wall 708 of the housing 102.

Figure 8:
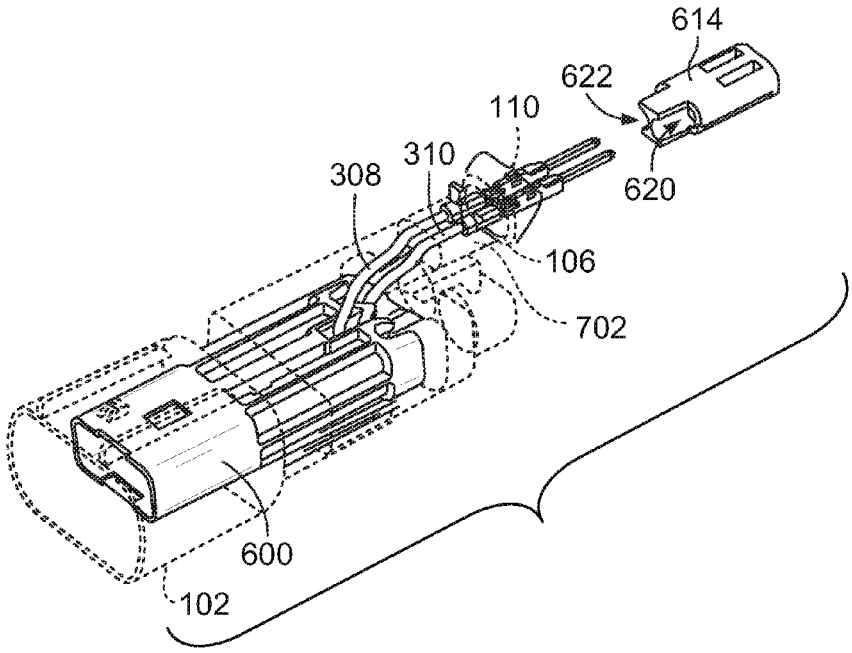
FIG. 8 is a partial exploded view of the connector assembly shown in FIG. 1 in a second stage of assembly with the housing shown in FIG. 1 shown in phantom in accordance with one embodiment.

FIG. 8 is partial exploded view of the connector assembly 100 in a second stage of assembly with the housing 102 shown in phantom in accordance with one embodiment of the present disclosure. The view shown in FIG. 8 does not include the shield 624 (shown in FIG. 6) so that the casing 600 may be more clearly seen. The casing 600 and interlock conductors 308, 310 are loaded into the housing 102 until the interlock conductors 308, 310 protrude from the back end 106 of the housing 102 through the interlock interface 110. The interlock conductors 308, 310 are configured to bend in order to smoothly transition from the cavity 700 to the interlock channel 702 without. The housing 102 is configured such that the channel 700 is bifurcated into the channels 702, 704 such that the interlock conductors 308, 310 are guided by the housing 102 from the cavity 700 to the interlock channel 702. As shown in FIG. 8, the rear ends 500, 502 protrude from the back end 106 of the housing 102.

The rear ends 500, 502 are loaded into the channels 620, 622 of the retainer 614 outside of the housing 102. For example, the back end 502 may be inserted into the channel 620 and the back end 500 may be inserted into the channel 622. The retainer 614 and rear ends 500, 502 may then be loaded into the interlock channel 702 of the housing 102 though the interlock interface 110 of the housing 102. Alternatively, the rear ends 500, 502 may be inserted into the retainer 614 inside of the housing 102. For example, the retainer 614 may be stationed inside the interlock channel 702 within the housing 102 and the rear ends 500, 502 may be inserted into the retainer 614 while the retainer 614 is located in the housing 102.

Figure 9:
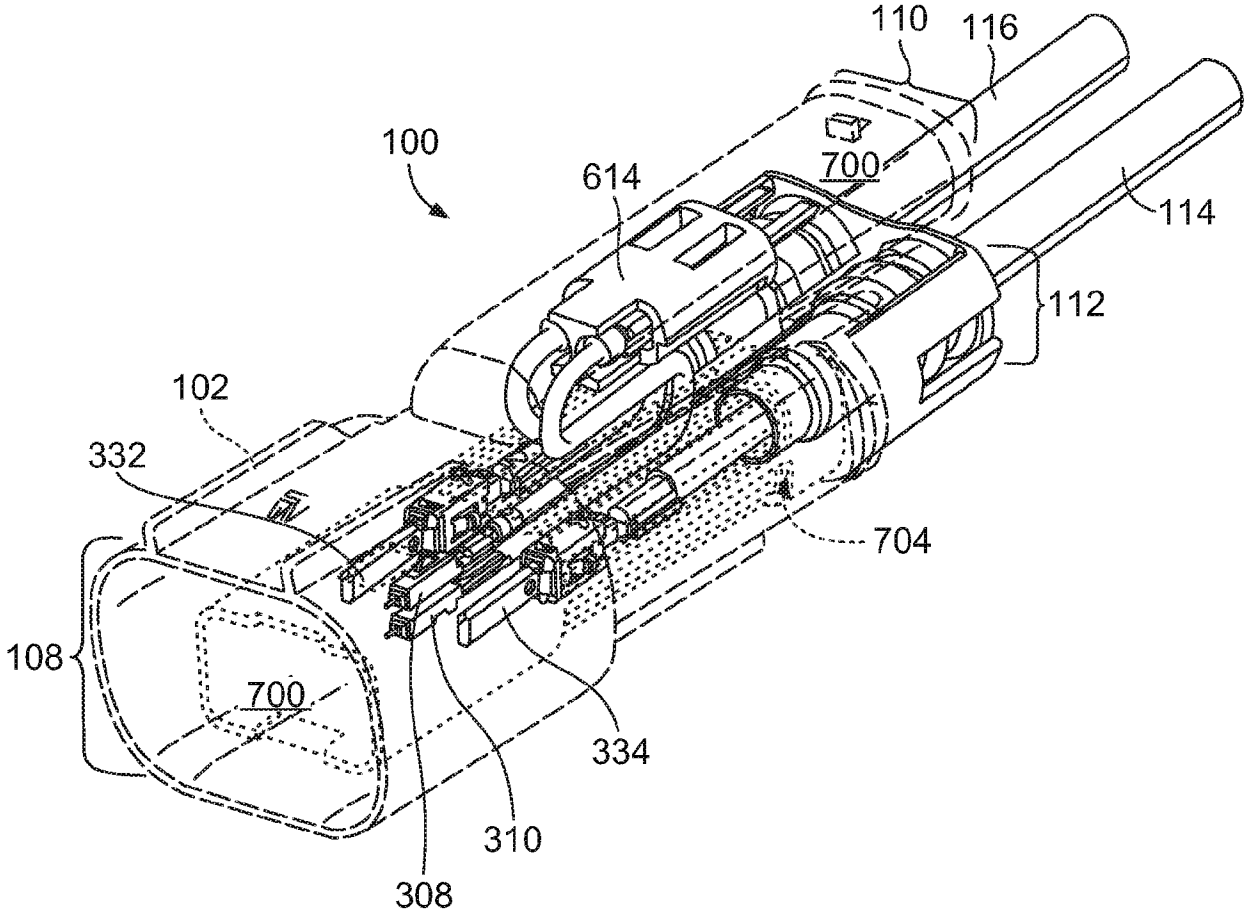
FIG. 9 is another perspective view of the connector assembly shown in FIG. 1 in accordance with one embodiment.

FIG. 9 is perspective view of the connector assembly 100 in the final stage of assembly with the housing shown in phantom accordance with one embodiment of the present disclosure. The housing 102 is shown in phantom view in FIG. 9 so that the interior of the housing 102 may be more clearly seen. As shown in FIG. 9, the current carrying conductors 332, 334 extend from locations in the cavity 700 near the connector interface 108 of the housing 102 through the conductor channel 704 to cables 114, 116 that protrude through the conductor interface 112. The interlock conductors 308, 310 extend from locations in the cavity 700 near the connector interface 108 through the interlock channel 702 and are held in place by the retainer 614 in the interlock channel 702. The retainer 614 may be secured in the interlock channel 702 by an interference fit, a latch, or another mechanism that secures the retainer 614 in the housing 102. When the rear ends 500, 502 are loaded into the retainer 614 and the retainer 614 is loaded into the housing 102, the interlock conductors 308, 310 may engage the back side 604 of the casing 600 to form the S-shapes shown in FIG. 9.

As described above, the first connector 300 (shown in FIG. 3) may mate with the connector interface 108 of the housing 102 so that conductive members 328, 330 and the shunt 312 engage the current carrying conductors 332, 334 and the interlock conductors 308, 310 in the cavity 700 via the single connector interface 108. The current carrying conductors 332, 334 and the interlock conductors 308, 310 split from one another inside the housing 102 such that the interlock conductors 308, 310 extend through the interlock channel 702 toward the interlock interface 110 and the current carrying conductors 332, 334 extend through the conductor channel 704 and are joined with the cables 114, 116. The cables 114, 116 protrude out of the housing 102 via the conductor channel 704 and may be coupled with one or more electric loads 322 (shown in FIG. 3).

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing having a cavity that receives conductive members and a shunt of a first connector, the cavity bifurcated into a conductor channel and an interlock channel that receives a conductive member of a second connector;

a current carrying conductor in the housing and extending through the cavity and the conductor channel; and an interlock conductor in the housing and extending through the cavity and the interlock channel, wherein the interlock conductor closes an interlock circuit when the interlock conductor mates the conductive member of the second connector with the shunt of the first connector and, wherein the current carrying conductors mate to the conductive members of the first connector to begin transferring electric current through the current carrying conductor when the interlock circuit is closed.

2. The connector assembly of claim 1, wherein the current carrying conductor mates with the conductive members and the interlock conductors mate with the shunt of the first connector in the cavity.

3. The connector assembly of claim 1, wherein the interlock channel and the conductor channel of the housing are separate from each other.

4. The connector assembly of claim 1, wherein the interlock channel and the conductor channel of the housing are separated by a wall of the housing.

5. The connector assembly of claim 1, wherein the housing extends from a front end to an opposite back end, the cavity inwardly extending from the front end, the interlock channel and the conductor channel inwardly extending from the back end.

6. The connector assembly of claim 1, wherein the housing includes an interlock interface that defines one end of the interlock channel and a conductor interface that defines one end of the conductor channel, the interlock interface and conductor interface being spaced apart from one another.

7. The connector assembly of claim 1, wherein the housing forms shrouds that separately encircle each of the conductor channel and the interlock channel at an end of the housing.

8. The connector assembly of claim 1, wherein the current carrying conductor is joined to a cable that extends out of the housing from the conductor channel.

9. The connector assembly of claim 1, further comprising a retainer that receives one end of each of the interlock conductors, the retainer holding the ends of the interlock conductors in the interlock channel when the retainer is loaded into the interlock channel.

10. A connector assembly comprising:

a housing extending between a front end and a back end, the front end defining a connector interface that mates with a first connector, the back end defining a conductor interface and an interlock interface that mate with a separate second connector;

a current carrying conductor disposed in the housing and extending from the connector interface to the conductor interface; and an interlock conductor disposed in the housing and extending from the connector interface to the interlock interface, the interlock conductor configured to close an interlock circuit that begins transferring the electric current through the current carrying conductor when the interlock circuit is closed.

11. The connector assembly of claim 10, wherein the current carrying conductor transfers electric current through a power supply circuit that is closed by the current carrying conductor.

12. The connector assembly of claim 10, wherein the housing includes a cavity that extends inward from the front end of the housing and is bifurcated into an interlock channel and a separate current carrying channel within the housing, the interlock channel extending to the interlock interface, the current carrying channel extending to the conductor interface.

13. The connector assembly of claim 12, wherein the current carrying conductor extends from the connector interface to the conductor interface of the housing via the cavity and the current carrying channel.

14. The connector assembly of claim 12, wherein the interlock conductor extends from the connector interface to the interlock interface of the housing via the cavity and the interlock channel.

15. The connector assembly of claim 10, wherein the interlock interface and the conductor interface are spaced apart from one another.

16. The connector assembly of claim 10, wherein the front end of the housing forms a first shroud that encircles the connector interface and the back end of the housing forms second and third shrouds, the second shroud encircling the conductor interface and the third shroud encircling the interlock interface.

17. The connector assembly of claim 10, wherein the front end and the back end of the housing are oriented opposite each other.

18. The connector assembly of claim 10, wherein the current carrying conductor is joined with a cable that extends through the conductor interface of the housing.

19. The connector assembly of claim 10, wherein the housing is a unitary body.

20. The connector assembly of claim 10, wherein the interlock conductor includes conductive terminals on opposite ends that mate with contacts in the first and second connectors.

21. The connector assembly of claim 1, wherein the cavity of the housing merges into the interlock channel and the conductor channel inside the housing.

22. The connector assembly of claim 10, wherein the cavity of the housing merges into the interlock channel and the conductor channel inside the housing.

* * * * *